US008973779B2

(12) United States Patent
Schütz

(10) Patent No.: US 8,973,779 B2
(45) Date of Patent: Mar. 10, 2015

(54) DRUM

(71) Applicant: Schütz GmbH & Co. KGaA, Selters/Westerwald (DE)

(72) Inventor: Udo Schütz, Selters/Westerwald (DE)

(73) Assignee: Schütz GmbH & Co. KGaA, Selters/Westerwald (DE)

( * ) Notice: Subject to any disclaimer, the term of this patent is extended or adjusted under 35 U.S.C. 154(b) by 0 days.

(21) Appl. No.: 13/849,778

(22) Filed: Mar. 25, 2013

(65) Prior Publication Data

US 2013/0213981 A1 Aug. 22, 2013

Related U.S. Application Data

(63) Continuation of application No. 11/316,225, filed on Dec. 22, 2005, now abandoned.

(30) Foreign Application Priority Data

Dec. 22, 2004 (DE) ..... 10 2004 061 677

(51) Int. Cl.
*B65D 6/40* (2006.01)
*B65D 1/40* (2006.01)
*B65D 1/20* (2006.01)

(52) U.S. Cl.
CPC ... *B65D 1/40* (2013.01); *B65D 1/20* (2013.01)
USPC ..... 220/601; 220/606; 220/634; 220/658

(58) Field of Classification Search
USPC ..... 220/601, 606, 608, 634, 645, 656, 657, 220/658, 659
See application file for complete search history.

(56) References Cited

U.S. PATENT DOCUMENTS

| | | | | | |
|---|---|---|---|---|---|
| 3,434,623 | A | * | 3/1969 | Cookson | 220/270 |
| 3,985,257 | A | * | 10/1976 | Shaffer et al. | 220/669 |
| 4,027,777 | A | * | 6/1977 | Blanke, Jr. | 220/295 |
| 4,108,324 | A | * | 8/1978 | Krishnakumar et al. | 215/373 |
| 4,257,527 | A | * | 3/1981 | Snyder et al. | 220/675 |
| 4,643,323 | A | * | 2/1987 | Schutz | 220/604 |
| 4,736,862 | A | * | 4/1988 | Hammes et al. | 220/601 |
| 4,776,479 | A | * | 10/1988 | Schutz | 220/4.05 |
| 4,898,296 | A | * | 2/1990 | Burgdorf et al. | 220/604 |
| 4,925,049 | A | * | 5/1990 | Przytulla | 220/675 |
| 5,014,873 | A | * | 5/1991 | Clemens et al. | 220/601 |
| 5,033,639 | A | * | 7/1991 | Przytulla | 220/604 |
| 5,044,510 | A | * | 9/1991 | Schutz | 220/4.05 |
| 5,217,142 | A | * | 6/1993 | Schutz | 220/601 |

(Continued)

FOREIGN PATENT DOCUMENTS

EP 0287966 10/1988

*Primary Examiner* — Fenn Mathew
*Assistant Examiner* — Christopher McKinley
(74) *Attorney, Agent, or Firm* — McGlew & Tuttle, P.C.

(57) ABSTRACT

Drums of thermoplastic synthetic material include a circumferentially extending carrying and transport ring arranged on the drum wall in the vicinity of the upper bottom, and at least one bunghole connection sleeve arranged in a trough-shaped indentation of the upper head of the drum in the area of the rim thereof. An integrally formed stiffening bead is arranged on the inner side of the carrying and transport ring of a drum of the above-described type in the vicinity of a bunghole connection sleeve. A stiffening hump is formed in the upper head of the drum between the stiffening bead of the carrying and transport ring and the bunghole connection sleeves.

10 Claims, 3 Drawing Sheets

(56) References Cited

U.S. PATENT DOCUMENTS

| | | | | | |
|---|---|---|---|---|---|
| 5,273,181 | A * | 12/1993 | Gay | 220/601 |
| 5,593,060 | A * | 1/1997 | Przytulla | 220/319 |
| 5,597,085 | A * | 1/1997 | Rauworth et al. | 220/581 |
| 5,881,898 | A * | 3/1999 | Irwin et al. | 220/319 |
| 5,918,757 | A * | 7/1999 | Przytulla et al. | 220/288 |
| 5,941,406 | A * | 8/1999 | Przytulla | 220/254.2 |
| 5,975,338 | A * | 11/1999 | Przytulla et al. | 220/601 |
| 5,984,133 | A * | 11/1999 | Schutz | 220/601 |
| 6,145,694 | A * | 11/2000 | Roesing | 220/601 |
| 6,419,109 | B1 * | 7/2002 | Julien et al. | 220/608 |
| 2002/0050494 | A1 * | 5/2002 | Rauworth et al. | 220/601 |
| 2006/0108371 | A1 * | 5/2006 | Rauworth et al. | 220/634 |

* cited by examiner

Fig. 3
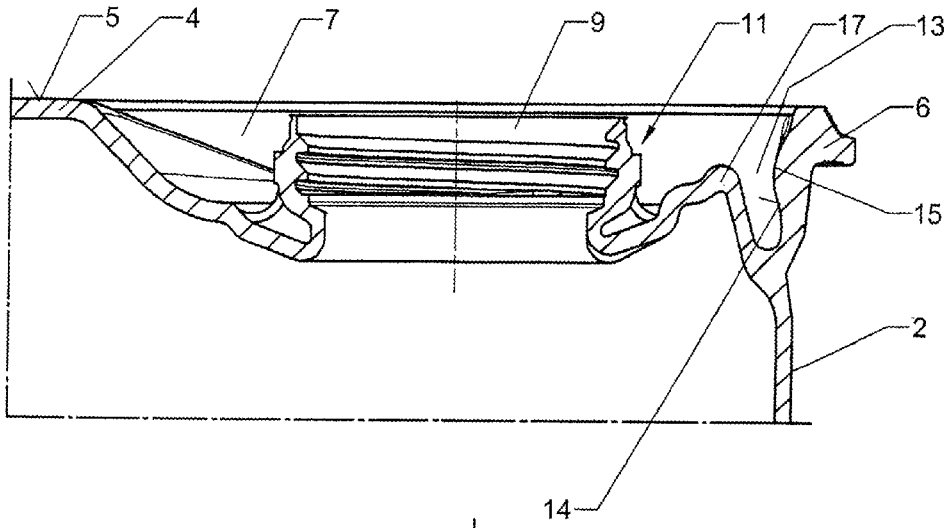
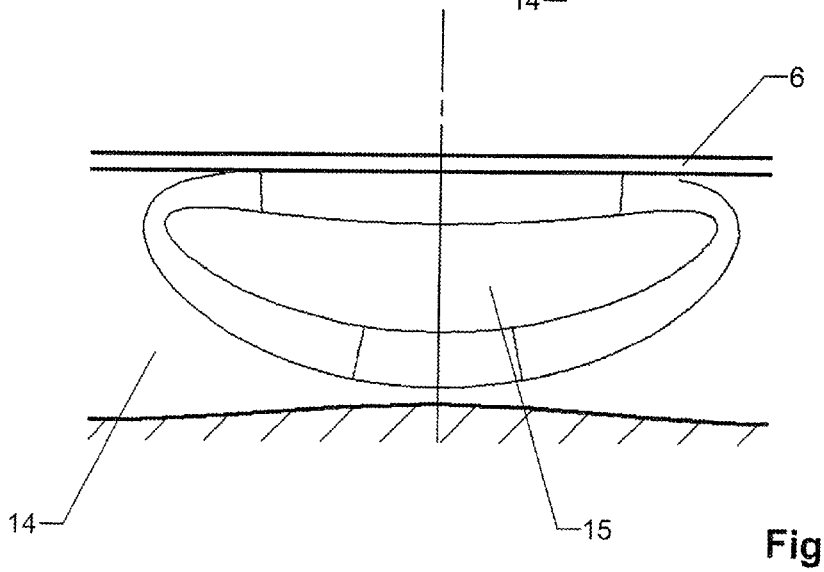
Fig. 4

DRUM

CROSS-REFERENCE TO RELATED APPLICATIONS

The present application is a Continuation Application of U.S. patent application Ser. No. 11/316,225, filed Dec. 22, 2005, which claims priority of DE 10 2004 061 677.9-27, filed Dec. 22, 2004, the priority of these applications is hereby claimed and these applications are incorporated herein by reference.

BACKGROUND OF THE INVENTION

The present invention relates to drums of thermoplastic synthetic material with a circumferentially extending carrying and transport ring arranged on the drum wall in the vicinity of the upper bottom, and at least one bunghole connection sleeve arranged in a trough-shaped indentation of the upper head of the drum in the area of the rim thereof.

The arrangement of the bunghole connection sleeve of the aerating and venting bung of a drum of the above-described type known from EP 0 287 966 A2 in the vicinity of the carrying and transport ring has the disadvantage that the bunghole connection sleeve is not protected even if arranged in a trough-shaped indentation of the upper head against external bending and compression forces which act laterally on the carrying and transport ring when the drum is dropped from a great height and which result in a deformation of the drum which inevitably has an effect on the bunghole connection sleeve of the aerating and venting bung. As a result, peak stresses may occur in the connection sleeve part and in areas adjacent this part which may lead to the formation of cracks and other damage, so that the tightness of the aerating and venting bung of the drum which is closed by a bung plug is no longer ensured.

SUMMARY OF THE INVENTION

It is the object of the present invention to improve the resistance of the drum of the above-described type in the area of bunghole connection sleeve or sleeves against loads resulting from external force applications.

In accordance with the present invention, the above object is met by integrally forming a stiffening bead on the inner side of the carrying and transport ring of a drum of the above-described type in the vicinity of a bunghole connection sleeve as well as by forming a stiffening hump in the upper head of the drum between the stiffening bead of the carrying and transport ring and the bunghole connection sleeves.

As a result of the geometry of the upper area of the drum, the carrying and transport ring is reinforced in the area of a bunghole connection sleeve which, in the event of an external force application against the carrying and transport ring, prevents damage to the bunghole connection sleeve up to a certain strength of the force at which the carrying and transport ring is still not being deformed. A deformation of the carrying and transport ring when the expansion limit of the material of which the drum is manufactured is not exceeded when subjected to an external force application, is prevented by the stiffening hump in the upper head of the drum and the direct force application on the bunghole connection sleeve which would result in damage is prevented.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 3 is a sectional view taken along sectional line III-III of FIG. 2; and FIG. 4 is a sectional view taken along sectional line IV-IV of FIG. 2.

DETAILED DESCRIPTION OF THE INVENTION

Figure 1:
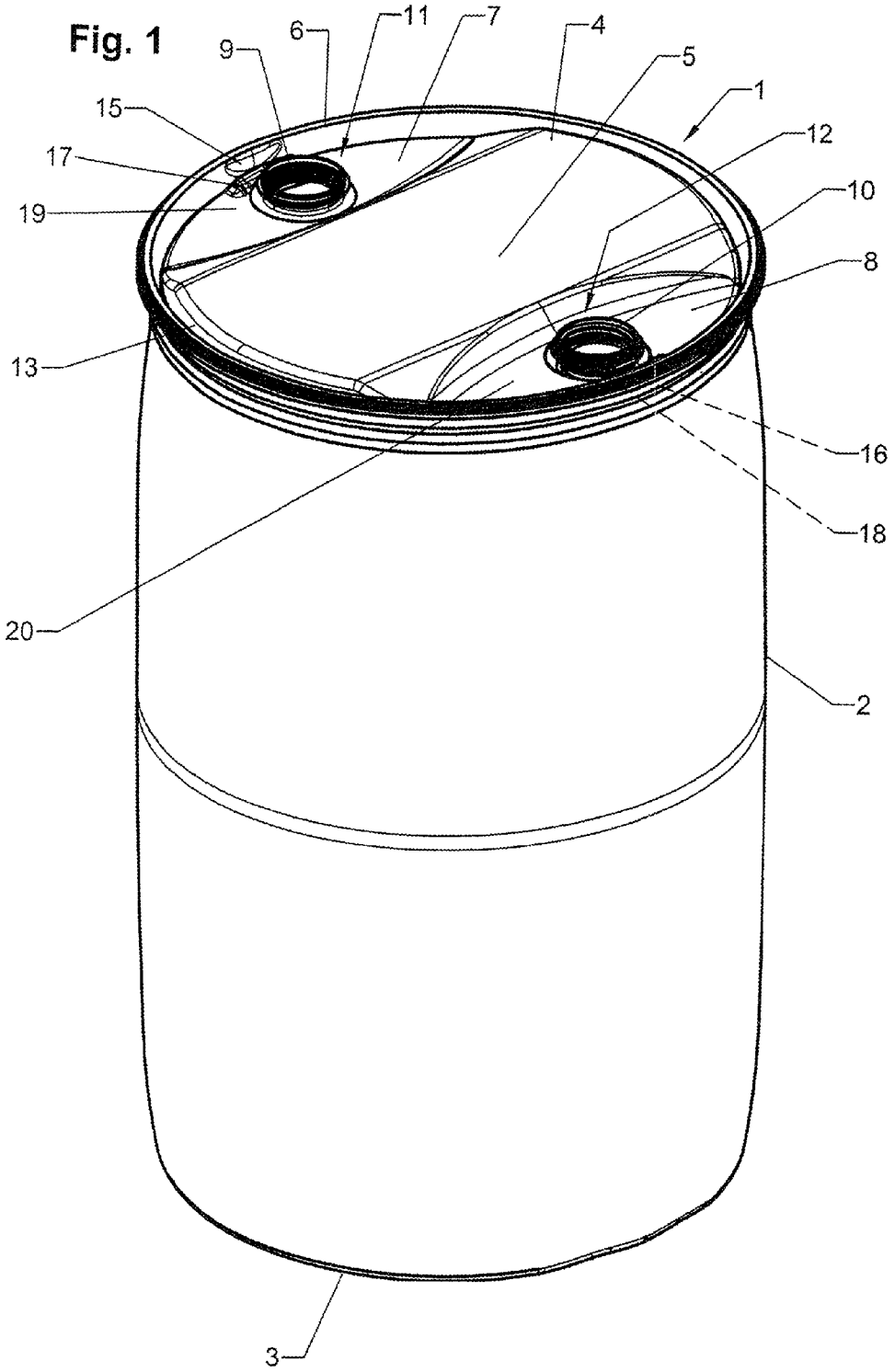
FIG. 1 is a perspective view of a drum according to the present invention.
Figure 2:
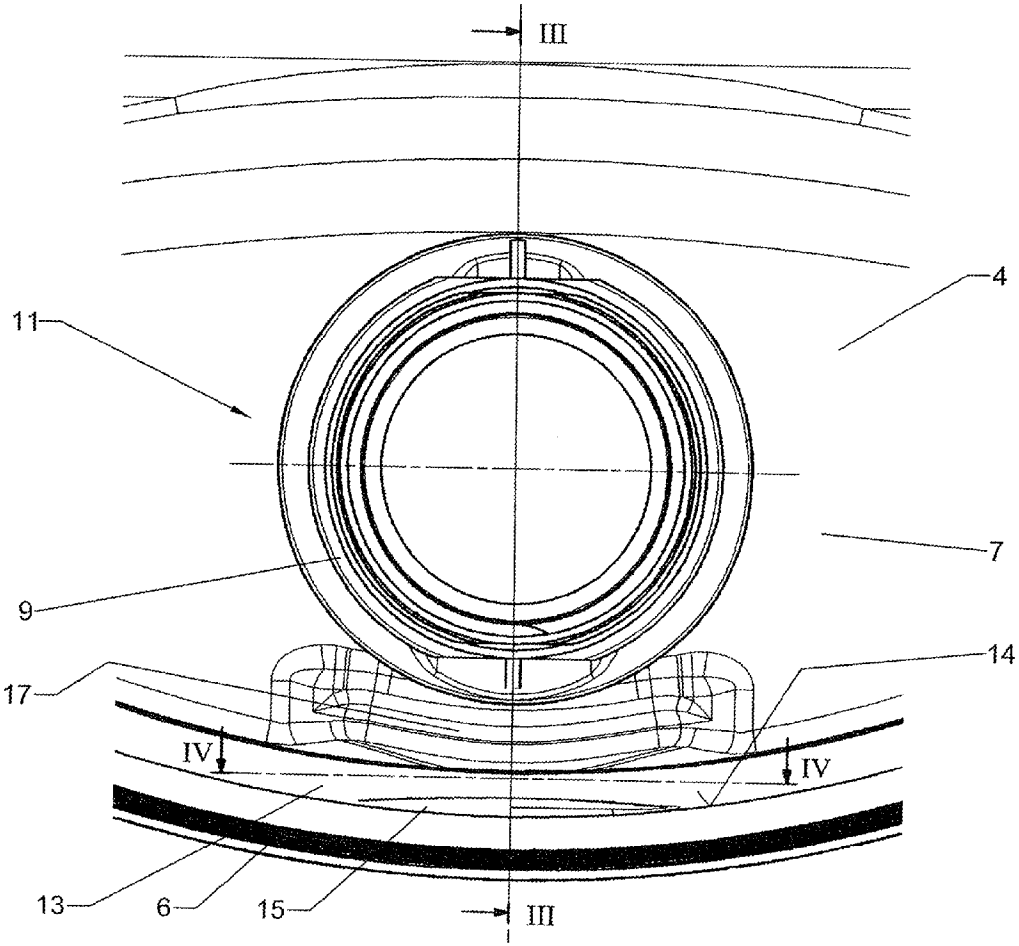
FIG. 2 is a top view of a detail of the upper head of the drum, only larger scale, showing the filling and discharge bung.

The drum 1 manufactured by extrusion blow molding from synthetic material is composed of a casing 2, a lower bottom 3, and an upper head 4 with a central stacking surface 5 and an outer carrying and transport ring 6.

The upper head 4 of the drum 1 has two trough-shaped indentations 7, 8; diametrically oppositely located in the indentations 7, 8 are the bunghole connection sleeves 9, 10 of a filling and discharge bung 11 and of an aerating and venting bung 12, wherein the connection sleeves are arranged recessed in the indentations 7, 8.

An engagement groove 13 for a drum gripper extends between the carrying and transport ring 6, on the one hand, and the stacking surface 5, and the two indentations 7, 8, on the other hand.

A stiffening bead 15, 16 each is integrally formed on the inner side 14 of the carrying and transport ring 6 in the vicinity of the bunghole connection sleeves 9, 10 of the filling and discharge bung 11 and the aerating and venting bung 12, and two stiffening humps 17, 18 are formed from the bottom sections 19, 20 of the two indentations 7, 8 of the upper head 4 of the drum between the stiffening beads 15, 16 of the carrying and transport ring 6 and the bunghole connection sleeves 9, 10 of the two bungs 11, 12.

While specific embodiments of the invention have been shown and described in detail to illustrate the inventive principles, it will be understood that the invention may be embodied otherwise without departing from such principles.

I claim:

1. A drum of thermoplastic synthetic material, the drum comprising:

a drum wall;

an upper head arranged at one end of said drum wall;

a lower bottom arranged at another end of said drum wall;

a circumferentially extending carrying and transport ring arranged on the drum wall in the vicinity of the upper head of the drum;

a bunghole connection sleeve arranged in a trough-shaped indentation of the upper head in a rim area thereof;

a stiffening hump extending integrally upwardly from the bottom section of the indentation of the upper head between the carrying and transport ring and the bunghole connection sleeve;

a stiffening bead integrally formed on an inner side of the carrying and transport ring in the vicinity of the bunghole connection sleeve so as to oppose the stiffening hump, the stiffening bead being configured to remain undeformed to a predetermined magnitude of force so as to prevent damage to the bunghole connection sleeve, the stiffening bead being solid and increasing a cross section of the carrying and transport ring in the vicinity of the bunghole connection sleeve, said stiffening bead having a maximum cross section in the vicinity of the bunghole connection sleeve and a cross section that diminishes with distance away from the vicinity of the bunghole connection sleeve, said cross section of said stiffening bead diminishing from said maximum cross section in opposite axial directions.

2. The drum according to claim 1, comprising:

a filling and discharge bung as well as an aerating and venting bung, wherein each bung has a bunghole connection sleeve and is arranged diametrically opposite in indentations of the upper head and in the area of the rim thereof, and stiffening beads arranged opposite the bunghole connection sleeves on the inner side of the carrying and transport ring, and stiffening humps integrally formed upwardly from the upper indentations between the stiffening beads and the bunghole connection sleeves, both stiffening beads being solid and increasing a cross section of the carrying and transport ring in the vicinity of the respective bunghole connection sleeve.

3. The drum according to claim 1, wherein:

said stiffening bead extends circumferentially and longitudinally along said carrying and transport ring in the vicinity of the bunghole connection sleeve, said stiffening bead extending further circumferentially than longitudinally.

4. A container comprising:

a side wall extending circumferentially around an axial axis, said side wall having an axial end;

an end wall arranged at said axial end of said side wall and extending across said axial end, said end wall defining a bung hole, said end wall including a stiffening hump arranged between said bung hole and said side wall for adsorbing force directed toward said bung hole;

a carrying and transport ring arranged at said axial end of said side wall and extending around said axial axis, said carrying and transport ring extending away from said end wall in a direction diametrically opposite from said side wall, said carrying and transport ring including a stiffening bead arranged at a circumferential position of said carrying and transport ring, said circumferential position being adjacent said bung hole, said carrying and transport ring having a radial thickness, said stiffening bead increasing said radial thickness of said carrying and transport ring at said circumferential position, said stiffening bead having a maximum thickness at said circumferential position and a thickness that diminishes with distance away from said circumferential position, said thickness of said stiffening bead diminishing from said maximum thickness in opposite axial directions.

5. A container in accordance with claim 4, wherein:

said stiffening bead is solidly filled and formed of a same material as said carrying and transport ring.

6. A container in accordance with claim 4, wherein:

said stiffening bead extends radially inward from said carrying and transport ring at said circumferential position.

7. A container in accordance with claim 4, wherein:

said stiffening bead extends circumferentially and axially along said carrying and transport ring at said circumferential position, said stiffening bead extends further in the circumferential direction than in the axial direction.

8. A container in accordance with claim 4, wherein:

said side wall, said end wall and said carrying and transport ring are formed of thermoplastic;

said end wall has a trough-shaped indentation directed inward of the container, said trough-shaped indentation being arranged adjacent said carrying and transport ring;

said bung-hole is arranged in said trough-shaped indentation.

9. A drum of thermoplastic synthetic material, the drum comprising:

a drum wall;

an upper head arranged at one end of said drum wall;

a lower bottom arranged at another end of said drum wall;

a circumferentially extending carrying and transport ring arranged on the drum wall in the vicinity of the upper head of the drum;

a bunghole connection sleeve arranged in a trough-shaped indentation of the upper head in a rim area thereof;

a stiffening hump extending integrally upwardly from the bottom section of the indentation of the upper head between the carrying and transport ring and the bunghole connection sleeve;

a stiffening bead integrally formed on an inner side of the carrying and transport ring in the vicinity of the bunghole connection sleeve so as to oppose the stiffening hump, the stiffening bead being configured to remain undeformed to a predetermined magnitude of force so as to prevent damage to the bunghole connection sleeve, the stiffening bead being solid and increasing a cross section of the carrying and transport ring in the vicinity of the bunghole connection sleeve;

a filling and discharge bung as well as an aerating and venting bung, wherein each bung has a bunghole connection sleeve and is arranged diametrically opposite in indentations of the upper head and in the area of the rim thereof, and stiffening beads arranged opposite the bunghole connection sleeves on the inner side of the carrying and transport ring, and stiffening humps integrally formed upwardly from the upper indentations between the stiffening beads and the bunghole connection sleeves, both stiffening beads being solid and increasing a cross section of the carrying and transport ring in the vicinity of the respective bunghole connection sleeve;

said stiffening bead extending circumferentially and axially along said carrying and transport ring in the vicinity of the bunghole connection sleeve, said stiffening bead extending further circumferentially than axially;

said stiffening bead having a maximum cross section in the vicinity of the bunghole connection sleeve and a cross section that diminishes with distance away from the vicinity of the bunghole connection sleeve; and said cross section of said stiffening bead diminishing from said maximum cross section in opposite axial directions.

10. A container comprising:

a side wall extending circumferentially around an axial axis, said side wall having an axial end;

an end wall arranged at said axial end of said side wall and extending across said axial end, said end wall defining a bung hole, said end wall including a stiffening hump arranged between said bung hole and said side wall for adsorbing force directed toward said bung hole;

a carrying and transport ring arranged at said axial end of said side wall and extending around said axial axis, said carrying and transport ring extending away from said end wall in a direction diametrically opposite from said side wall, said carrying and transport ring including a stiffening bead arranged at a circumferential position of said carrying and transport ring, said circumferential position being adjacent said bung hole, said carrying and transport ring having a radial thickness, said stiffening bead increasing said radial thickness of said carrying and transport ring at said circumferential position, said stiffening bead being solidly filled and formed of a same material as said carrying and transport ring, said stiffening bead extending radially inward from said carrying and transport ring at said circumferential position, said stiffening bead extending circumferentially and axially along said carrying and transport ring at said circumferential position, said stiffening bead extending further circumferentially than axially, said stiffening bead having a maximum thickness at said circumferential position and a thickness that diminishes with distance away from said circumferential position, said thickness of said stiffening bead diminishing from said maximum thickness in opposite axial directions;

said side wall, said end wall and said carrying and transport ring being formed of thermoplastic;

said end wall having a trough-shaped indentation directed inward of the container, said trough-shaped indentation being arranged adjacent said carrying and transport ring; and said bung-hole being arranged in said trough-shaped indentation.

* * * * *